US006572268B2

(12) United States Patent
Ichikawa

(10) Patent No.: US 6,572,268 B2
(45) Date of Patent: Jun. 3, 2003

(54) LIQUID CONTAINER

(75) Inventor: Toru Ichikawa, Misato (JP)

(73) Assignee: Kabushiki Kaisha Hosokawa Yoko, Tokyo-to (JP)

( * ) Notice: Subject to any disclaimer, the term of this patent is extended or adjusted under 35 U.S.C. 154(b) by 0 days.

(21) Appl. No.: 09/842,901

(22) Filed: Apr. 27, 2001

(65) Prior Publication Data

US 2001/0036326 A1 Nov. 1, 2001

(30) Foreign Application Priority Data

Apr. 28, 2000 (JP) ..... 2000-130186

(51) Int. Cl.[7] ..... B65D 30/20

(52) U.S. Cl. ..... 383/120; 383/80; 383/116; 383/906; 222/92

(58) Field of Search ..... 383/80, 120, 906, 383/116; 222/211, 92, 107, 464.1, 464.2

(56) References Cited

U.S. PATENT DOCUMENTS 4,592,092 A * 5/1986 McPhee ..... 383/80
4,669,124 A * 5/1987 Kijura ..... 383/80
4,732,299 A * 3/1988 Hoyt ..... 383/80 X
5,660,477 A * 8/1997 Ichikawa ..... 383/80
6,241,122 B1 * 6/2001 Araki et al. ..... 222/92

FOREIGN PATENT DOCUMENTS

DE 3119179 * 12/1982 ..... 383/906

* cited by examiner

*Primary Examiner*—Jes F. Pascua
(74) *Attorney, Agent, or Firm*—Birch, Stewart, Kolasch & Birch, LLP

(57) ABSTRACT

A liquid container is capable of standing alone and of being used as a water supply container after the same has been emptied. The liquid container (1) includes a container body (4) formed from a laminate film in the shape of a bag, and having a pair of side walls (2) and a pair of gussets (3) extended between opposite side edges of the pair of side walls (2) on the opposite sides of the side walls (2), respectively; and a mouthpiece (8) provided with a flange (7) attached to an open end part of the container body (4), and at least two spouts (5, 6) formed on the flange (7). Each of the gussets (3) is capable of being folded in two along a fold line (3*a*) inward, the flange (7) has end surfaces (7*a*) on the side of the gussets (3) and side surfaces (7*b*) on the side of the side walls (2), the folded gussets (3) are extended from the end surfaces (7*a*) to the side surfaces (7*b*) of the flange (7) so that the folds (3*a*) of the gussets (3) folded in two are positioned on the side surfaces (3*b*), respectively.

12 Claims, 5 Drawing Sheets

LIQUID CONTAINER

BACKGROUND OF THE INVENTION

1. Field of the Invention

The present invention relates to a liquid container capable standing alone and suitable for containing liquid nourishment, such as intestinal nourishment.

2. Description of the Related Art

Generally, intestinal nourishment is a calorific food containing protein and fat in high concentrations. Intestinal nourishment is placed on the market in pouches containing about 1000 ml or about 1500 ml of intestinal nourishment.

Intestinal nourishment is prepared according to the condition of a patient and hence there are a variety of articles of intestinal nourishment. Usually, patient's name is written on a surface of a pouch containing intestinal nourishment beside the name of the intestinal nourishment indicated on the surface of the pouch to give rightly a predetermined article of intestinal nourishment prescribed for a specified patient to the specified patient.

As shown in FIG. 7, pouches 30 hermetically containing intestinal nourishment are piled on a tray 32 included in a cart 31 provided with casters, the cart 31 loaded with the pouches 30 is carried to hospital rooms and the pouches 30 containing intestinal nourishment are distributed to patients.

If an article of intestinal nourishment improper for the patient is given to the patient, it is possible that the patient is unable to digest the article of intestinal nourishment, the patient suffers from diarrhea or the concentration of patient's blood increases. The patient is supplemented with water after giving intestinal nourishment to the patient to prevent the patient from diarrhea and increase in blood concentration. In some cases, the patient is supplemented by an additional liquid medicine or an examination liquid depending on the condition of the patient during or after giving the intestinal nourishment to the patient.

As shown in FIG. 8, the conventional pouch 30 hermetically containing intestinal nourishment includes a container formed from a laminate film and having a pair of gussets 3 and a pair of side walls 2, and a spout 105 having a flange 7 attached to one end of the container and a pipe connected to the flange. This pouch 30 is incapable of standing alone because the center fold 3*a* of the gusset 3 the end part 7*a* of the flange 7, and the gusset cannot be formed in a width substantially equal to that of the side walls and hence the bottom wall is formed inevitably in an elongate, rectangular shape.

Since the conventional pouches 30 hermetically containing intestinal nourishment are incapable of standing alone, the pouches 30 cannot be loaded in a standing position on the tray 32 of the cart 31. Therefore, the pouches 30 are piled up on the tray 32 of the cart 31 for transportation.

When picking up a desired pouch 30 containing an article of intestinal nourishment proper for the patient from the tray 32 of the cart 31 after carrying the pouches 30 respectively hermetically containing articles of intestinal nourishment to a destination, the desired pouch 30 can be easily picked up without trouble if the same is in an upper part of a pile of the pouches 30. If the desired correct pouch 30 is in a lower part of the pile of the pouches 30, the same cannot be picked up unless the other pouches 30 overlying the desired pouch 30 are removed.

Thus, work for picking up the desired pouch 30 from the tray 32 of the cart 31 needs time and labor and it is possible that a wrong pouch 30 containing an article of intestinal nourishment not prepared for the patient is given to the patient.

It is desirable to use the empty pouch 30 for supplementing the patient by water after giving the patient intestinal nourishment. However, since the pouch 30 is provided with a single spout and a tube connected to the spout, water cannot be poured through the spout into the pouch 30 and another container containing water must be used for supplementing the patient by water.

SUMMARY OF THE INVENTION

The present invention has been made in view of the aforesaid problems and it is therefore an object of the present invention to provide a liquid container for containing a liquid, capable of being carried in a standing position and of being used for containing another liquid after the same has been emptied of the liquid initially contained therein.

According to one aspect of the present invention, a liquid container comprises: a container body formed from a laminate film in a shape of a bag, and having a pair of side walls and a pair of gussets extended between opposite side edges of the pair of side walls on the opposite sides of the side walls, respectively, each of the gussets being capable of being folded in two along a fold line inward; a mouthpiece provided with a flange attached to an open end part of the container body, and at least two spouts formed integrally with the flange, the flange having end surfaces on the side of the gussets and side surfaces on the side of the side walls; wherein the folded gussets are extended from the end surfaces to the side surfaces of the flange of the mouthpiece so that folds of the gussets folded in two are positioned on the side surfaces, respectively.

Since each folded gusset folded in two along a fold is extended from the end surface to the side surface of the flange so that the fold thereof is positioned on the side surface, the gussets can be formed in a width substantially equal to that of the side walls and a substantially square bottom wall can be formed when the gussets are extended and hence the liquid container is able to stand alone.

Since the mouthpiece is provided with at least the two spouts, one of the spout can be used for replenishing the liquid container with water even if a tube is connected to the other spout to supply the intestinal nourishment to the user.

BRIEF DESCRIPTION OF THE DRAWINGS

The above and other objects features and advantages of the present invention will become more apparent from the following description taken in connection with the accompanying drawings, in which.

DESCRIPTION OF THE PREFERRED EMBODIMENTS

Figure 1:
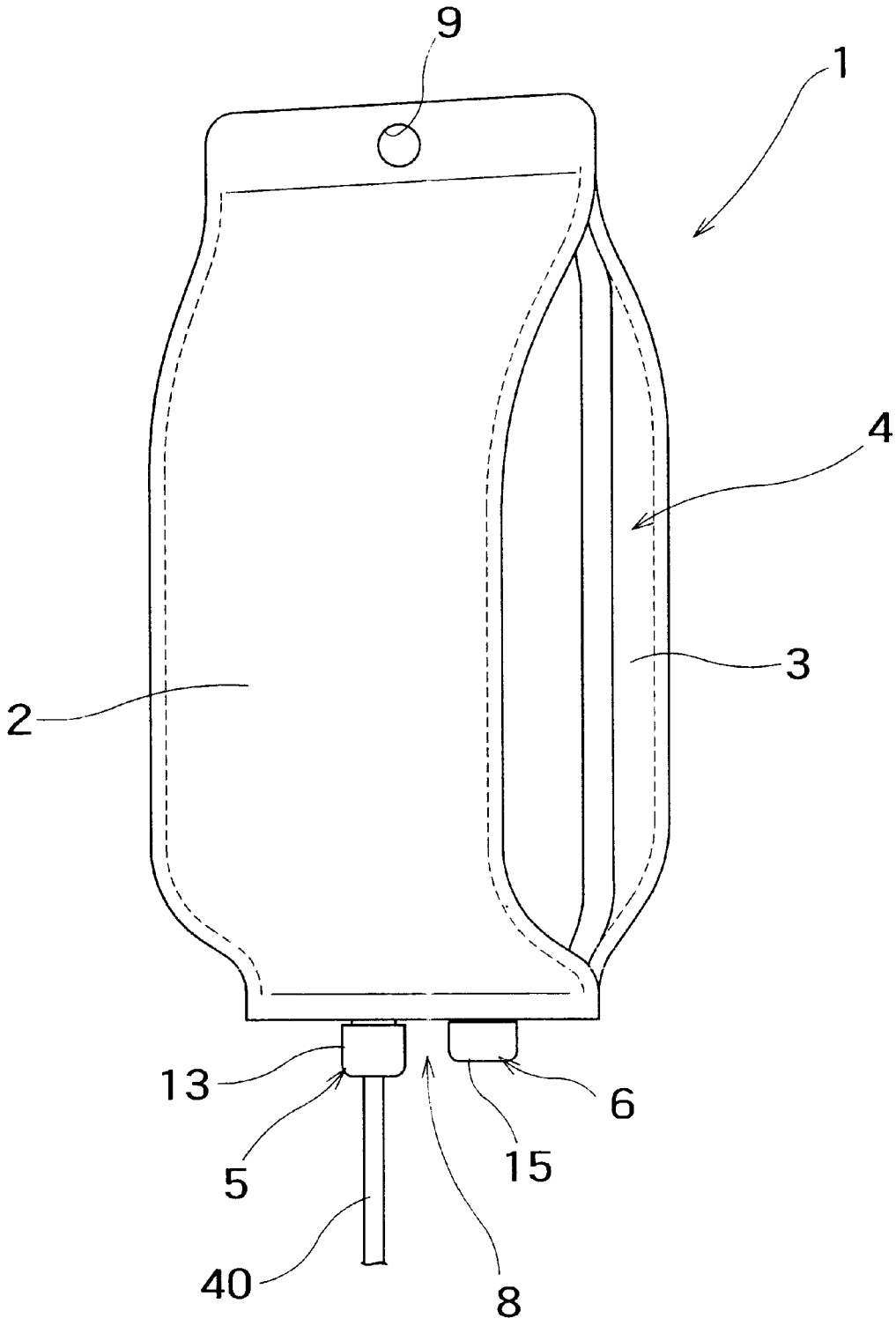
FIG. 1 is a perspective view of a liquid container in a first embodiment according to the present invention.
Figure 2:
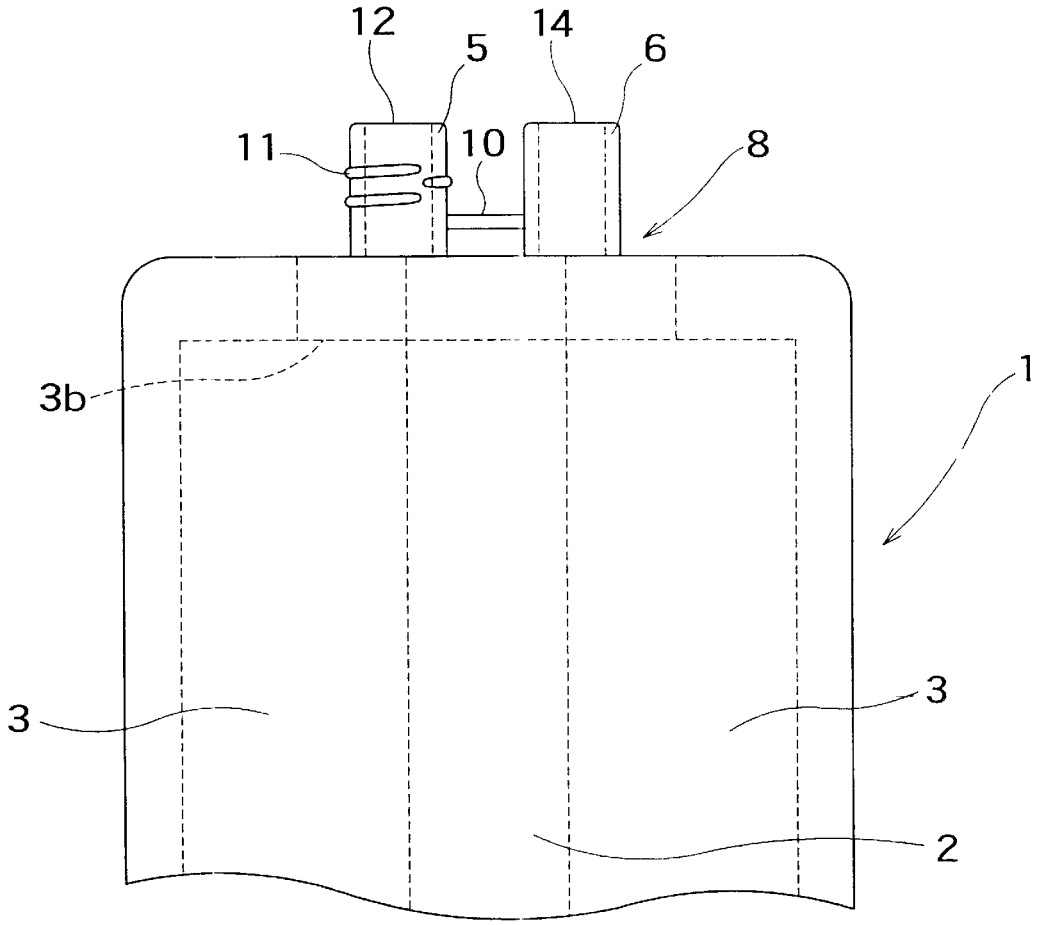
FIG. 2 is a front elevation of an open end part of the liquid container shown in FIG. 1.

Referring to FIGS. 1 and 2, a liquid container 1 in a first embodiment according to the present invention has a container body 4 including side walls 2 and a pair of gussets 3, and a mouthpiece 8 having two spouts 5 and 6 arranged side by side and a flange 7. An opening 9 is formed in a fin part formed in an end of the container body 4 opposite the side of the mouthpiece 8.

The mouthpiece 8 is formed of a resin and the two spouts 5 and 6 and the flange 7 are formed in a unit. Although the spouts 5 and 6 may have equal inside diameters, it is preferable that the spouts 5 and 6 have different inside diameters suitable for different purposes, respectively. As shown in FIG. 2, the two spouts 5 and 6 are arranged in a line and are interconnected by a connecting member 10. The small spout 5, i.e., the spout having an inside diameter smaller than that of the other spout, is used for filling an article of intestinal nourishment in the liquid container 1 and for pouring out the article of intestinal nourishment from the liquid container 1. The large spout 6 is used for filling water in the liquid container 1 after all the article of intestinal nourishment has been discharged from the liquid container 1 and for pouring out the water contained in the liquid container 1.

The small spout 5 is provided with an external thread 11 as shown in FIG. 2. A sealing sheet 12 is attached to the upper end of the small spout 5 and a cap 13 is screwed on the small spout 5 provided with the external thread 11. A sealing plug 14 is fitted in the large spout 6 and a cap 15 is put on the large spout 6.

Figure 3:
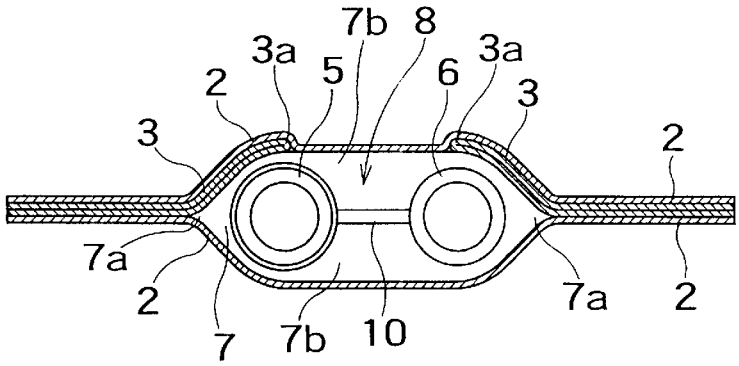
FIG. 3 is a sectional view of the liquid container shown in FIG. 1.

As shown in FIG. 2, the liquid container 1 is formed by attaching the mouthpiece 8 to the open end part 1*b* of the container body 4 having the shape of a bag. Each gusset 3 as folded inward extends along one side surface of the flange 7 so as to underlie one of the side walls 2 as shown in FIG. 3. The gusset 3, the flange 7 and the side wall 2 are united together by a heat-sealing machine, not shown.

As shown in FIGS. 2 and 3, the liquid container 1 formed from a laminate film has the container body 4 having the shape of a bag and the mouthpiece 8. The container body 4 includes the pair of gussets 3 and the side walls 2. Each gusset 3 can be folded in two along a fold 3*a* so as to extend inside the container body 4. The mouthpiece 8 has the flange 7 attached to the open end part 1*b* of the container body 4 and the two spouts 5 and 6 formed integrally with flange 7. The flange 7 has end parts 7*a* on the side of the gussets 3 and side parts 7*b* on the side of the side walls 2. As shown in FIG. 3, the fold 3*a* of each gusset 3 folded in two is on the side part 7*b*, and the folded gusset 3 extends between the end part 7*a* and the side part 7*b*.

Since the fold 3*a* of the gusset 3 folded in two is on the side part 7*b* of the flange 76 and the folded gusset 3 extends between the end part 7*a* and the side part 7*b*, the gussets 3 can be formed in a width equal to that of the sidewalls 2. When making the liquid container 1 containing a liquid stand alone, a bottom wall can be spread in a square shape, so that the liquid container 1 is able to stand stably alone.

As shown in FIG. 3, the gussets 3 of the liquid container 1, folded in two so as to extend between the side walls 2 are in contact with one side surface of the flange 7. Therefore, when the width ratio between the gussets 3 and the side walls 2 is nearly equal to 1.0, a substantially square bottom is formed when the liquid container 1 is set in a standing position and hence the liquid container 1 is able to stand stably alone.

Figure 9:
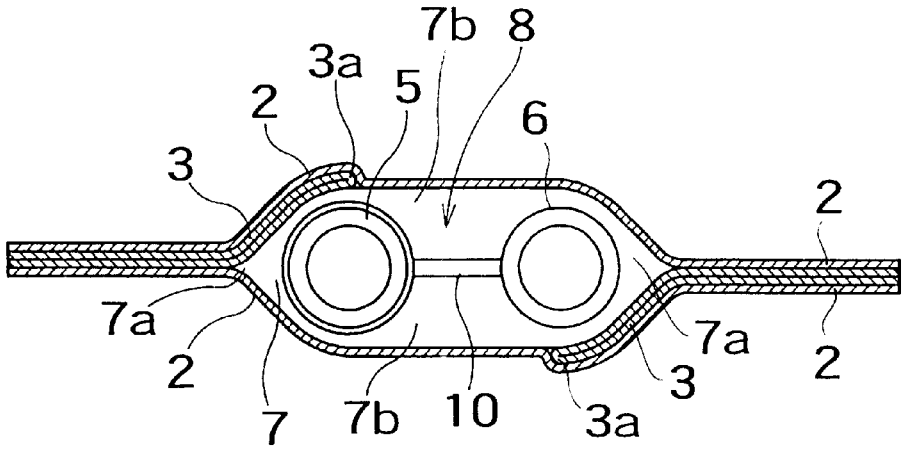
FIG. 9 is a sectional view of another embodiment of the liquid container shown in FIG. 1.

Although the folded gussets 3 are placed in contact with the same side surface of the flange 7 of the mouthpiece 8 in this embodiment, one of the gussets 3 may be placed in contact with one of the side surfaces of the flange 7 and the other gusset 3 may be placed in contact with the other side surface of the flange 7 as shown in FIG. 9.

Figure 4:
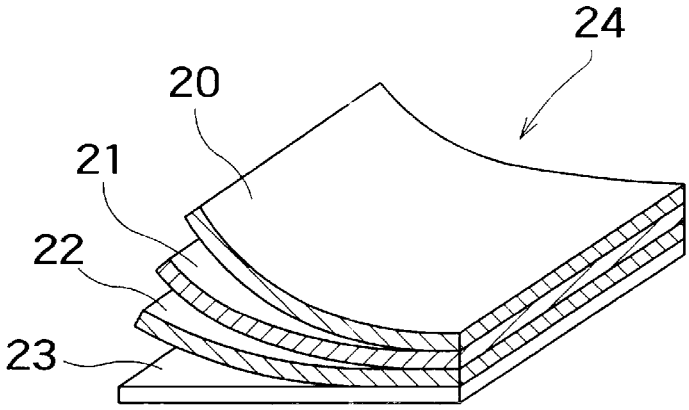
FIG. 4 is a perspective view of a laminate film from which the liquid container shown in FIG. 1 is formed.

As shown in FIG. 4, the container body 4 is formed from a laminate film 24 formed by laminating a 12 $\mu$m thick polyester film 20, a 9 $\mu$m thick aluminum foil 21, a 15 $\mu$m thick oriented nylon film 22 and 100 to 120 $\mu$m thick polyethylene film 23.

It is preferable to replace the polyethylene film of the laminate film 24 with a nonoriented polypropylene film when the liquid container 1 is expected to be subjected to a retorting process.

When the liquid container 1 is used for containing an intestinal nourishment, the sealing plug 14 is fitted in the large spout 6, the cap 15 is put on the large spout 6, the intestinal nourishment is poured through the small spout 5 into the container body 4, the sealing sheet 12 is attached to the small spout 5, and the cap 13 is screwed on the small spout 5 provided with the external thread 11. The name of the intestinal nourishment contained in the liquid container 1 is indicated on at least one of the side walls 2 of the liquid container 1.

Figure 5:
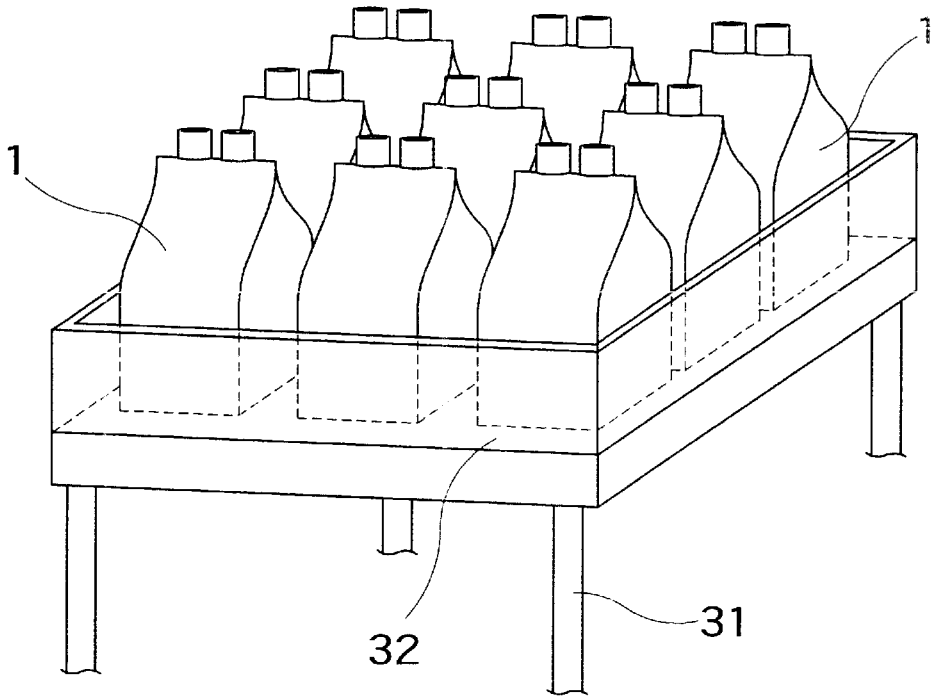
FIG. 5 is a perspective view of a part of a cart carrying liquid container according to the present invention.

When carrying liquid containers 1 analogous with the aforesaid liquid container 1 according to the present invention to desired places by a cart 31 provided with casters, the liquid containers 1 are set in a standing position on a tray 32 as shown in FIG. 5. Since the liquid containers 1 are capable of standing alone, the liquid containers 1 will not fall down during transportation. Since the liquid containers 1 are arranged regularly on the tray 32 of the cart 31, the liquid containers 1 containing articles of intestinal nourishment specially prepared for specific patients can be correctly delivered to the specific patients, respectively.

When giving the intestinal nourishment contained in the liquid container 1, the cap 13 is removed from the small spout 5, the sealing sheet 12 is peeled off the open end of the small spout 5, a tube 40 is connected by a connector, not shown, to the small spout 5, the liquid container 1 is inverted, the hook of a support structure, not shown, is engaged in the opening 9, the free end of the tube 40 is inserted in the patient's mouth to supply the intestinal nourishment from the liquid container 1 to the patient.

When using the empty liquid container 1 for containing water after the intestinal nourishment contained therein has been exhausted, the empty liquid container 1 is removed from the support structure, the cap 15 is removed from the large spout 6, the sealing plug 14 is removed from the large spout 6, the large spout 6 is connected to a water tank, not shown, containing water by a pipe and water is poured through the pipe into the liquid container 1. When thus filling water in the liquid container 1, air remaining in the liquid container 1 is discharged through the tube 40, so that water can be efficiently filled in the liquid container 1.

When giving water contained in the liquid container 1 to the patient, the liquid container 1 is inverted, the hook of the support structure is engaged in the opening 9, the free end of the tube 40 is inserted in the patient's mouth.

If the patient needs to be supplemented by an additional liquid medicine or an examination liquid depending on the condition of the patient during or after giving the intestinal nourishment to the patient, the liquid container 1 is removed from the support structure, a liquid medicine, such as a liquid antibiotic, or an examination liquid is injected through the large spout 6 into the liquid container 1.

Figure 6:
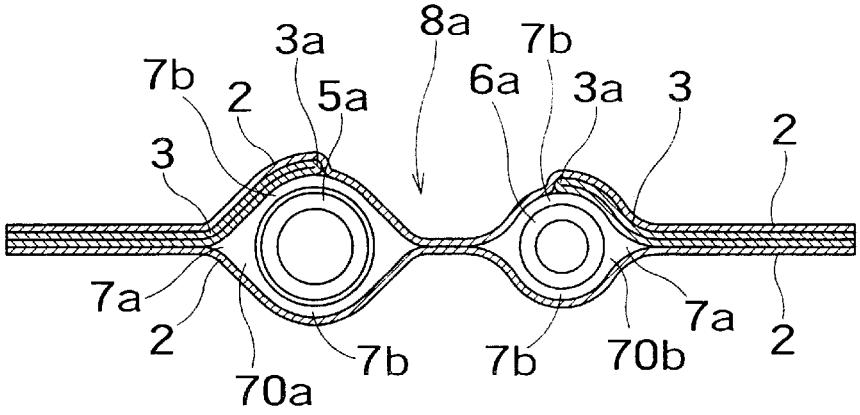
FIG. 6 is a sectional view of a liquid container in a second embodiment according to the present invention.

Referring to FIG. 6 showing a liquid container in a second embodiment according to the present invention, a mouthpiece 8*a* is provided with two spouts 5*a* and 6*a* formed integrally with flanges 70*a* and 70*b*, respectively. The flanges 70*a* and 70*b* are disposed adjacently in an open end part of a container body 4 and are attached individually to the open end part of the container body 4. One of a pair of folded gussets 3 is placed in contact with the flange 70*a* provided with the spout 5*a*, the other folded gusset 3 is placed in contact with the flange 70*b* provided with the spout 6*a*, side walls 2 are extended over the flanges 70*a* and 70*b* and the folded gussets 3, and the side walls 2, the folded gussets 3 and the flanges 70*a* and 70*b* are joined together by a heat-sealing machine, not shown.

Figure 7:
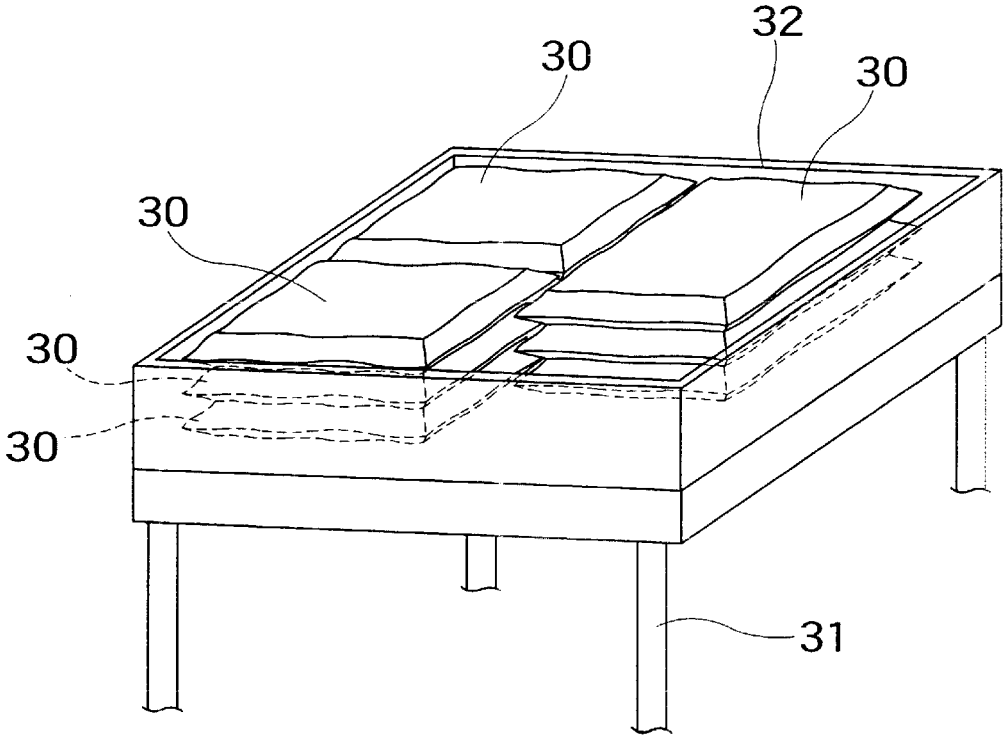
FIG. 7 is a perspective view of a part of a cart carrying conventional containers.
Figure 8:
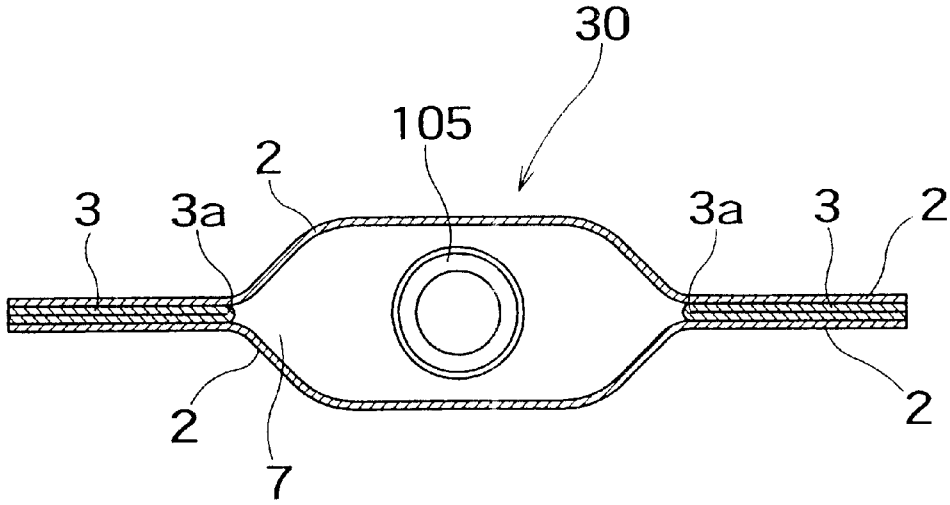
FIG.8 PRIOR ART
FIG. 8 is a sectional view of a conventional liquid container.

The respective inside diameters of the spouts 5*a* and 6*a* are greatly different from each other. If the spouts 5*a* and 6*a* respectively having the greatly different inside diameters are formed integrally with a single flange like the flange 7 shown in FIG. 7, it is difficult to join the gussets 3 and the side walls 2 to both the spouts 5*a* and 6*a* satisfactorily because the spouts 5*a* and 6*a* have different heat transfer properties, respectively.

Therefore, in the second embodiment, the two spouts 5*a* and 6*a* are formed integrally with the separate flanges 70*a* and 70*b*, respectively, to achieve the heat-sealing process satisfactorily.

Although the liquid container in the first embodiment is provided with the two spouts 5 and 6, and the liquid container in the second embodiment is provided with the two spouts 5*a* and 6*a*, a liquid container according to the present invention may be provided with three or more spouts.

As apparent from the foregoing description, according to the present invention, the mouthpiece is provided with at least the two spouts, one of which is used for filling nourishment in the container body and the other is used for pouring out the nourishment from the container body and the other is used for filling water in the container body, pouring out the water from the container body and adding a liquid medicine to the water contained in the container body. Since each folded gusset folded in two along a fold is extended from the end surface to the side surface of the flange so that the fold thereof is positioned on the side surface, the gussets can be formed in a width substantially equal to that of the side walls and a substantially square bottom wall can be formed when the liquid container is set on a support surface in a standing position and the gussets are extended. Thus the liquid container is able to stand alone.

What is claimed is:

1. A liquid container comprising:

a container body formed from a laminate film in a shape of a bag, and having a pair of side walls and a pair of gussets extended between opposite side edges of the pair of side walls on the opposite sides of the side walls, respectively, each of the gussets being capable of being folded in two along a fold line inward;

a mouthpiece provided with a flange attached to an open end part of the container body, and at least two spouts formed on the flange, the flange having end surfaces on the side of the gussets and side surfaces on the side of the side walls;

wherein each folded gusset extends from an end surface to a respective point on one of the side surfaces of the flange and each respective point is aligned with one of said spouts of the mouthpiece so that folds of the gussets folded in two are positioned on the side surfaces, respectively.

2. The liquid container according to claim 1, wherein the spouts are formed integrally with the flange.

3. The liquid container according to claim 1, wherein the flange is formed in a single piece.

4. The liquid container according to claim 1, wherein the flange is formed in two or more pieces, and the two or more spouts are formed on the two or more pieces of the flange, respectively.

5. The liquid container according to claim 1, wherein the mouth piece is provided with two spouts.

6. The liquid container according to claim 5, wherein the two spouts have different inside diameters, respectively.

7. The liquid container according to claim 1, wherein the respective folds of the two gussets folded in two lie on the same side surface of the flange of the mouthpiece.

8. The liquid container according to claim 1, wherein the respective folds of the two gussets folded in two lie on the opposite side surfaces of the flange of the mouthpiece, respectively.

9. The liquid container according to claim 1, wherein an opening in which a support member included in a support structure for supporting the container body engages is formed in an end part of the container body opposite the open end part of the same to which the mouthpiece is attached.

10. The liquid container according to claim 1, wherein each point on the side surfaces of the flange is in line with a center of one of said spouts.

11. The liquid container according to claim 1, wherein the side surfaces are two substantially parallel side surfaces spaced by a distance greater than a diameter of said spouts and having a length at least equal to a distance between centers of said spouts.

12. A liquid container comprising:

a container body formed from a laminate film in a shape of a bag, and having a pair of side walls and a pair of gussets extended between opposite side edges of the pair of side walls on the opposite sides of the side walls, respectively, each of the gussets being capable of being folded in two along a fold line inward;

a mouthpiece provided with a flange attached to an open end part of the container body, and at least two spouts formed on the flange, only one of said spouts having external threads, the flange having end surfaces on the side of the gussets and side surfaces on the side of the side walls, said side walls being separated by a distance greater than a largest diameter of said at least two spouts, said end surfaces being inclined from said side surfaces to form a point at either end of said flange, said points being separated by a distance greater than the sum of the diameters of said at least two spouts;

wherein the folded gussets extend from said end points along inclined surface of said end surfaces.

* * * * *